US005707058A

United States Patent [19]

Hirth et al.

[11] Patent Number: 5,707,058

[45] Date of Patent: Jan. 13, 1998

[54] METHOD OF INTRODUCING AN AUXILIARY PILE CARRIER

[75] Inventors: Roland Hirth, Römberg; Edmund Klein, Wilhelmsfeld; Richard Mack, Brühl, all of Germany

[73] Assignee: Heidelberger Druckmaschinen AG, Heidelberg, Germany

[21] Appl. No.: 632,084

[22] Filed: Apr. 15, 1996

[30] Foreign Application Priority Data

Apr. 15, 1995 [DE] Germany ..... 195 14 176.8
Mar. 28, 1996 [DE] Germany ..... 196 12 280.5

[51] Int. Cl.[6] ..... B65H 43/00

[52] U.S. Cl. ..... 271/176; 271/189; 271/183; 271/204; 271/218

[58] Field of Search ..... 271/176, 189, 271/191, 218, 183, 204–206

[56] References Cited

U.S. PATENT DOCUMENTS

| | | | |
|---|---|---|---|
| 3,271,027 | 9/1966 | Liedl et al. | 271/191 |
| 3,477,712 | 11/1969 | Stotzer . | |
| 3,567,047 | 3/1971 | Clausen | 271/191 X |
| 3,960,374 | 6/1976 | Gaffney | 271/189 |
| 4,469,321 | 9/1984 | Geschwindner . | |
| 4,643,414 | 2/1987 | Weisgerber . | |
| 4,712,787 | 12/1987 | Princiotta, Sr. et al. | 271/176 X |
| 5,131,647 | 7/1992 | Henn et al. . | |

FOREIGN PATENT DOCUMENTS

| | | | |
|---|---|---|---|
| 40 01 565 A1 | 7/1991 | Germany . | |
| 4011286 | 4/1992 | Germany . | |
| 42 21 928 A1 | 1/1994 | Germany . | |
| 167161 | 6/1989 | Japan | 271/189 |
| 2157272 | 10/1985 | United Kingdom | 271/218 |

*Primary Examiner*—Boris Milef
*Attorney, Agent, or Firm*—Herbert L. Lerner; Laurence A. Greenberg

[57] ABSTRACT

Method of introducing an auxiliary sheet pile carrier above a main sheet pile to be removed, the introduction being effected during uninterrupted feeding of additional sheets above the main sheet pile in a sheet travel direction and in synchronism with the travel of a sheet to be deposited, includes controlling respective drives at a sheet delivery by a control device which determines actual data of a printing press, so that the auxiliary pile carrier traverses a velocity profile identical with a velocity profile of the sheet to be deposited in order to avoid relative movement between the auxiliary pile carrier and the sheet to be deposited.

14 Claims, 5 Drawing Sheets

METHOD OF INTRODUCING AN AUXILIARY PILE CARRIER

BACKGROUND OF THE INVENTION

1. Field of the Invention

The invention relates to a method of introducing an auxiliary sheet pile carrier or support above a main sheet pile to be removed, the introduction being made during the uninterrupted feeding of additional sheets and being effected in sheet travel direction and in synchronism with the travel of a sheet above a main sheet pile and depositable thereon.

A problem exists in a sheet delivery of printing presses that a sheet pile can only reach a limited height if press operation is not to be interrupted for removal of the pile. For maintaining a high productivity of printing presses, the printing speed should also not be reduced for this purpose. At high printing speeds, the manual insertion of a rake as an auxiliary pile carrier or support offers no solution, because one or more oncoming sheets are damaged during the insertion process. The disruption of sheet travel resulting therefrom can also lead to a necessity for stopping the press in order to remove such damaged sheets.

The published German Patent Document 40 01 565 A1 discloses a sheet-fed printing press. The approach described therein relates to a sheet delivery with proof or specimen sheet removal equipment and/or a non-stop auxiliary pile device of a sheet-fed printing press with a sheet catcher introducible into the sheet deposit path and with a movable sheet stop for a leading edge of a sheet. To avoid damage to the sheets, a control device is provided which activates the sheet catcher and/or the sheet stop in accordance with parameters affecting the sheet deposit characteristics or behavior, especially the operating parameters of the sheet-fed printing press.

The published German Patent Document 42 42 259 A1 is concerned with a sheet-fed rotary printing press with a proof or specimen sheet delivery. The advance proposed therein relates to a sheet-fed rotary printing press having a delivery which, in addition to at least one main sheet pile, has at least one auxiliary sheet pile for a proof or specimen sheet delivery, a conveyor system for transporting the sheet, and releasing members for releasing the sheet from the conveyor system either above the main or the auxiliary sheet pile. Moreover, sensors for determining the position of the sheet are provided, which emit electrical pulses to a computer of the press control system. An automatic proof or specimen sheet delivery is preselectable in a selective proof or specimen sheet cycle at the computer, documentation of measurement data registered in continuous printing being storable in memory with a coding characteristic for the appertaining proof or specimen sheet.

Finally, the state of the art is exemplified in the published German Patent Document 42 21 928 A1 by a device for non-stop pile exchange in a delivery associated with the proof or specimen sheet. An auxiliary pile carrier or support is insertable between two sheets in the direction in which the sheets are being conveyed and accepts the oncoming sheets in passing on an auxiliary pile. In this heretofore known device, means for depositing the auxiliary pile on a new main pile carrier after the main pile exchange are provided. The auxiliary pile carrier has a relatively small thickness and remains below the auxiliary pile, so that it is effective as an underlayer when it is deposited on the exchanged main pile carrier. Such an auxiliary pile carrier can either be cut from a web roller or taken individually from an interchangeable cassette.

SUMMARY OF THE INVENTION

It is accordingly an object of the invention to provide an improved method of introducing an auxiliary sheet pile carrier of the foregoing general type which, in a relatively simple manner, permits the auxiliary pile carrier or support to be introduced in a fast-running press without impairment of sheet travel and sheet deposition.

With the foregoing and other objects in view, there is provided, in accordance with the invention, a method of introducing an auxiliary sheet pile carrier above a main sheet pile to be removed, the introduction being effected during uninterrupted feeding of additional sheets above the main sheet pile in a sheet travel direction and in synchronism with the travel of a sheet to be deposited, which comprises controlling respective drives at a sheet delivery by a control device which determines actual data of a printing press, so that the auxiliary pile carrier traverses a velocity profile identical with a velocity profile of the sheet to be deposited in order to avoid relative movement between the auxiliary pile carrier and the sheet to be deposited.

In accordance with another mode, the method according to the invention includes determining the velocity profile from a conveying velocity of a gripper by which the sheet to be deposited is grippable and from a velocity of a brake surface for braking the sheet.

In accordance with a further mode, the method according to the invention includes controlling the auxiliary pile carrier so that a leading end thereof reaches a position above an end of the main pile facing towards the printing press jointly with a leading end of the respective sheet to be deposited.

In accordance with an added mode, the method according to the invention includes jointly delaying the sheet to be deposited and the auxiliary pile carrier closely before an end of the main pile facing away from the printing press.

In accordance with an additional mode, the method according to the invention includes determining with the control device actual data of the printing press including press speed, press angle and sheet format.

In accordance with yet another mode, the method according to the invention includes reconciling a position of a gripper opening cam, via a drive assigned thereto, with a drive of a sheet brake, and reconciling an acceleration profile thereof by comparison with an acceleration profile stored in a memory of the control device.

In accordance with yet a further mode, the method according to the invention includes controlling the drives, respectively, of the auxiliary pile carrier, a sheet brake and gripper opening cam adjusting equipment by the control device dependent upon actual data of the printing press.

In accordance with yet an added mode, the method according to the invention includes providing a brake surface of a sheet brake, during the introduction of the auxiliary pile carrier, with a velocity profile corresponding to a speed of a gripper for gripping the sheet to be deposited, up to an instant of time at which the gripper is opened.

In accordance with yet an additional mode, the method according to the invention includes decelerating the brake surface of the sheet brake, after the instant of time at which the gripper is opened, until the brake surface reaches a sheet deposit velocity of the sheet to be deposited.

In accordance with still another mode, the method according to the invention includes guiding the auxiliary pile carrier so as to switch off the drive for the auxiliary pile carrier with a switch after the auxiliary pile carrier has reached an end position thereof.

In accordance with still a further mode, the method according to the invention includes guiding the auxiliary pile carrier on linear units furnished with preceding and succeeding traverse distances.

In accordance with a concomitant mode, the method according to the invention includes, during operation of the printing press, applying a new printing form to a plate cylinder of the printing press by digital illumination.

An advantage of the method according to the invention is that the insertion or introduction of the auxiliary pile carrier is possible in a completely undisturbed course of operation. A high printing speed can be maintained, and the introduction or insertion of the auxiliary pile carrier or support occurs without any adverse effect upon the sheet travel and the sheet deposition. No separating elements such as suction grippers or the like are necessary in order to produce a gap for the introduction of the auxiliary pile carrier. Because no relative velocity occurs between the sheet and the auxiliary pile carrier, due to the synchronous operation, no smearing between the the auxiliary pile carrier and the sheet is possible, which is especially important for recto/verso printing. Furthermore, the auxiliary pile carrier can be applied precisely at the velocity of the sheet to be deposited, which permits the separation of a precisely defined number of sheets. This permits, in turn, a precise coordination of a given sheet with the new pile. This may be of great importance if, by means of digital illumination, during the operation of the printing press, a new printing form is applied to the plate cylinders.

In a further form of the method according to the invention, the auxiliary pile carrier is controlled so that the leading end thereof jointly with the leading end of the sheet to be deposited reaches a position above the end of the main pile facing towards the printing press, and that the auxiliary pile carrier moves with the same speed as that of the sheet above the main pile. The auxiliary pile carrier and the sheet to be deposited jointly reach a stop at an end of the main pile facing away from the printing press, so that the occurrence of a relative velocity between the upper side of the auxiliary pile carrier and the underside of the sheet to be deposited is avoidable and a clean deposit of the sheet is achievable.

Advantageously, the sheets to be deposited and the auxiliary pile carrier are jointly braked starting from a position which is as close as possible before the end of the main pile facing away from the printing press. In this regard, the velocity of the auxiliary pile carrier can correspond to the velocity of the sheet, the velocity of the auxiliary pile carrier and the velocity of the sheet brake being reconciled with one another. This also serves for preventing any relative velocities between the sheet and the auxiliary pile carrier, which is especially important when a press operates in recto/verso printing mode, wherein the underside of the sheet which comes into contact with the auxiliary pile carrier is printed on.

In a further development of the inventive concept, the control device detects or determines actual press data such as the actual press speed, the press angle and the sheet format. The setting of the gripper opening cam is reconciled via a drive assigned thereto with the drive of the sheet brake, and the acceleration profile thereof by a comparison with the data filed in a storage memory of the control device. The drives of the auxiliary pile carrier, the sheet brake and the brake surface thereof and the gripper opening cam adjustment equipment are controlled by the control device in accordance with or dependent upon the actual printing-press data. The pile separation of the main and the auxiliary pile is thus independent of the skill of an operator.

In particular, the brake surface of the sheet brake traverses a displacement profile during the introduction or insertion of the auxiliary pile carrier, the displacement profile corresponding to the velocity of the gripper until the instant of time at which the gripper opens, whereas the brake surface of the sheet brake, after this instant of time at which the gripper opens, decelerates until the respectively desired sheet deposition velocity of the sheet to be deposited is reached.

After the auxiliary pile carrier has reached the end position thereof, it automatically switches off the drive assigned thereto in order to keep mechanical and electrical loadings small; for this purpose, the linear units guiding the auxiliary pile carrier are provided with preceding and succeeding traverse distances or lengths.

Other features which are considered as characteristic for the invention are set forth in the appended claims.

Although the invention is illustrated and described herein as embodied in method of introducing an auxiliary sheet pile carrier, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
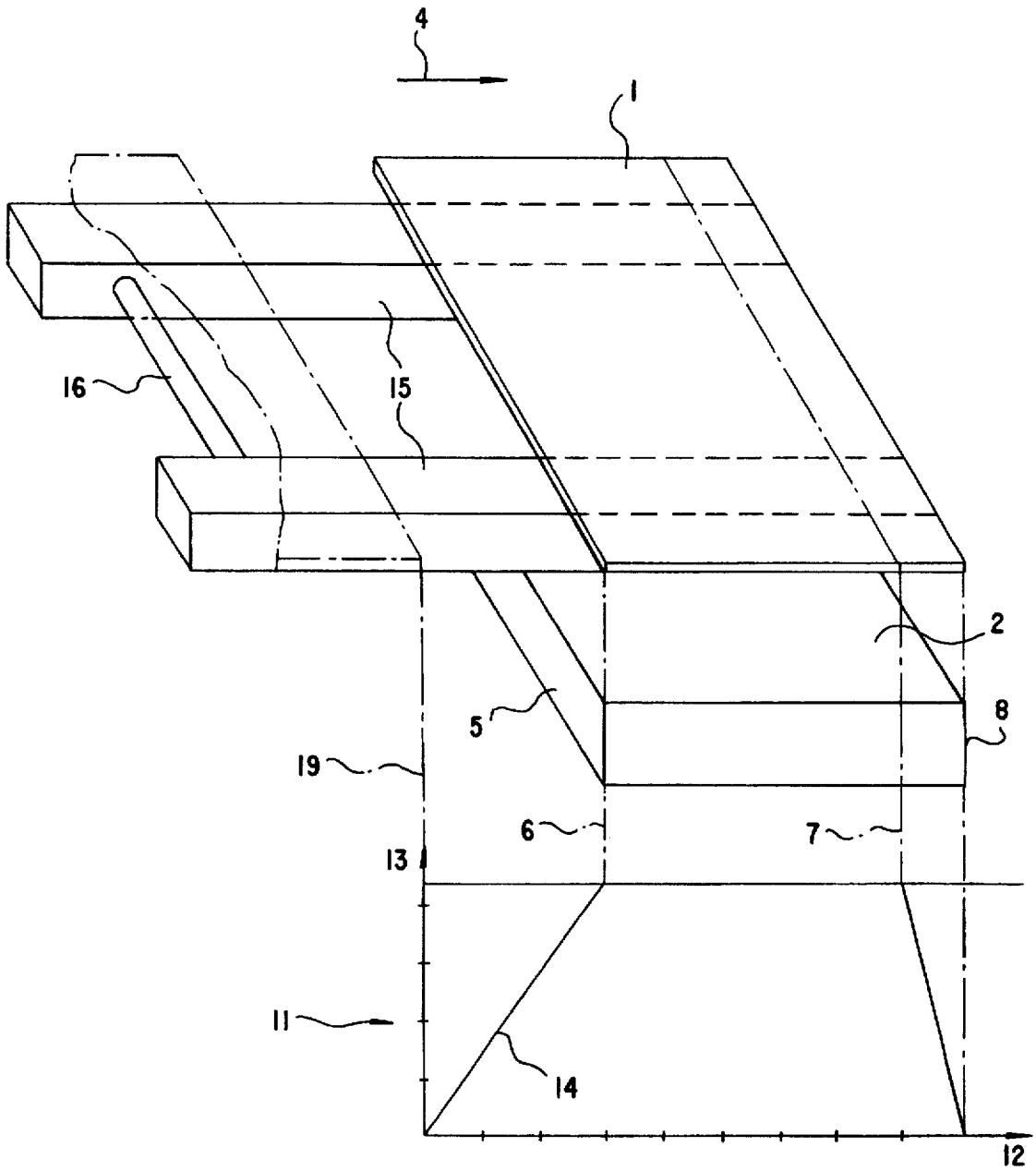
FIG. 1 is a perspective view of an auxiliary pile carrier, with a displacement-velocity diagram superimposed thereon.

Referring now to the drawings and, first, particularly to FIG. 1 thereof, there is shown therein an auxiliary pile carrier or support 1 together with a displacement-velocity plot diagram 11, wherein the velocity curve 14 of the auxiliary pile carrier 1 is represented. The auxiliary pile carrier 1 is shown diagrammatically and may be formed as a plate, a rake or have any other suitable construction. A linear unit 15 promotes the horizontal displaceability of the auxiliary pile carrier 1, and a drive shaft 16 is connected to a drive system which permits high acceleration and brief braking. Before the insertion of the auxiliary pile carrier 1 begins, it is located with the leading edge thereof at the level of the line 19 shown in phantom which marks the rest position of the withdrawn auxiliary pile carrier 1. As the velocity curve 14 shows, the auxiliary pile carrier 1 is sharply accelerated before the insertion thereof, in fact, in such a manner that it reaches the position 6 shown in phantom at the end of the main pile 2 facing towards the press, i.e., towards the left-hand side of FIG. 1, simultaneously with a sheet 3 (note FIG. 2) which is to be deposited. The auxiliary pile carrier 1 begins its acceleration, therefore, with a leap forward with respect to the sheet 3 which is to be deposited. The auxiliary pile carrier 1 then travels over the main pile 2 synchronously with the sheet 3 to be deposited, being braked simultaneously with the sheet 3 at a position 7 shown in phantom, so as to come to a stop at an end 8 of the main pile 2 facing away from the press. The displacement-velocity diagram 11 shows the velocity 13 of the auxiliary pile carrier 1 over the aforedescribed path 12.

Figure 2:
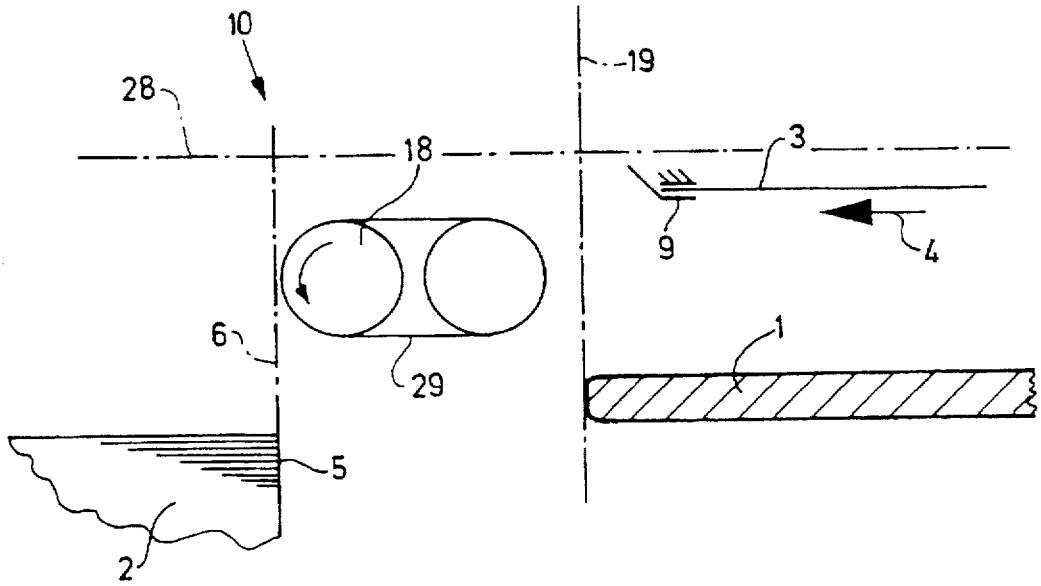
FIG. 2 is a diagrammatically represented sheet delivery with an auxiliary pile carrier in rest position.
Figure 3:
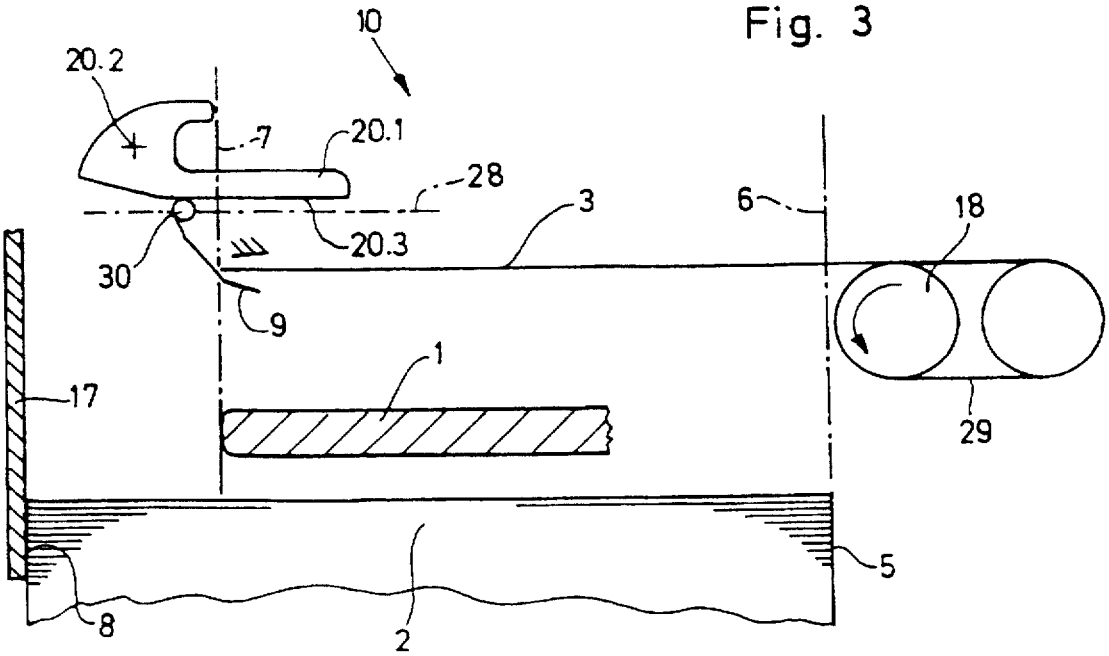
FIG. 3 is view like that of FIG. 2 of the sheet delivery in another operating phase thereof wherein the auxiliary pile carrier is being introduced, and showing diagrammatically an adjustable gripper opening cam.

FIGS. 2 and 3 show a diagrammatically represented sheet delivery 10, in FIG. 2 of which the auxiliary pile carrier 1 is in the rest position 19 thereof. FIG. 3 shows the auxiliary pile carrier 1 as it is being inserted.

FIG. 2 shows the auxiliary pile carrier 1 in the rest position 19 thereof and, thereover, a gripper 9 of the sheet delivery 10 which transports a sheet 3 in the sheet travel direction 4 so as to deposit it on the main pile 2. Because the main pile 2, however, is supposed to be removed, the auxiliary pile carrier 1 must be inserted. The auxiliary pile carrier 1, in the illustrated position 19 thereof, has leaped forward in front of the sheet 3 and is accelerated until it reaches the position 6 thereof at the end 5 of the main pile 2 facing towards the press, in such a manner that it, with the leading edge thereof, comes on simultaneously with the leading edge of the sheet 3 and also with the same speed as that of the sheet 3.

From the position 6 thereof, the auxiliary pile carrier 1 and the sheet 3 are displaced synchronously over the main pile 2, until they reach the position 7 thereof, wherein braking begins. This press position is illustrated in FIG. 3. In the position 7, a sheet brake 18, which is is formed as a suction roller, for example, is activated and brakes or decelerates the sheet 3. Initially, the grippers 9 of the sheet delivery 10 open, and the auxiliary pile carrier 1 is braked to the same extent as the sheet 3. The auxiliary pile carrier 1 and the sheet 3 continue to move until they reach the end 8 of main pile 2 facing away from the press, and the sheet 3 impacting with a stop 17 deposits on the auxiliary pile carrier 1. The main pile 2 can then be removed, because all of the succeeding sheets deposit on the auxiliary pile carrier 1. After the main pile 2 has been removed, the auxiliary pile carrier 1 can be extended again so that the the sheets 3 can deposit on a pallet of the main pile 2, or the auxiliary pile carrier 1 remains and accepts the new main pile 2 thereon. For such a case, the auxiliary pile carrier 1 must be separated from the linear unit 15 and the drive 16 and a new auxiliary pile carrier 1 must be made available, if a main pile 2 should again be removed.

In FIGS. 2 and 3, a chain strand 28 is represented in phantom, which is followed by the grippers 9 mounted on gripper bars. The sheet brake 18 has a brake surface 29 which, on the one hand, can be formed on a suction roller casing subjected to negative pressure and, on the other hand, can also be a revolving brake surface formed on a belt. In FIG. 3, there is also shown a gripper opening cam 20.1 which is adjustable about a pivot point 20.2 of a servomotor 20 (note FIG. 6), so that a roller 30 of the respectively present gripper 9 comes into contact with a first section of a contour 20.3 of the gripper opening cam 20.1 which is of conventional construction for a conventional main pile delivery. On the other hand, the gripper opening cam 20.1 can also be pivoted in a manner that the sheets 3 to be deposited are fed to a proof or specimen sheet removal device, at which a second section of the contour 20.3 of the gripper opening cam 20.1 then activates the rollers 30 of the grippers 9.

Figure 4:
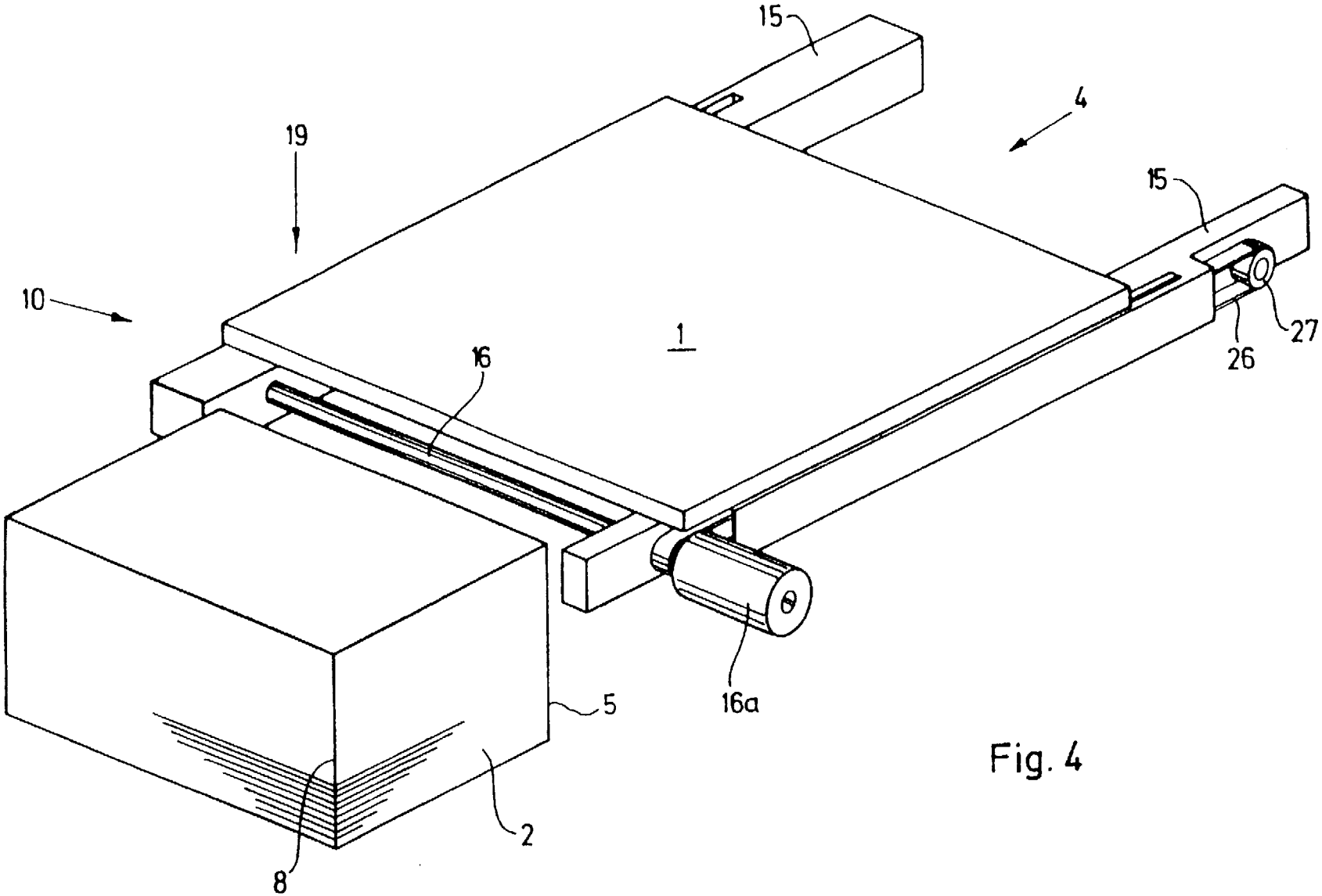
FIG. 4 is a perspective view of the driven auxiliary pile carrier on linear guides, the auxiliary pile carrier being in rest position.
Figure 5:
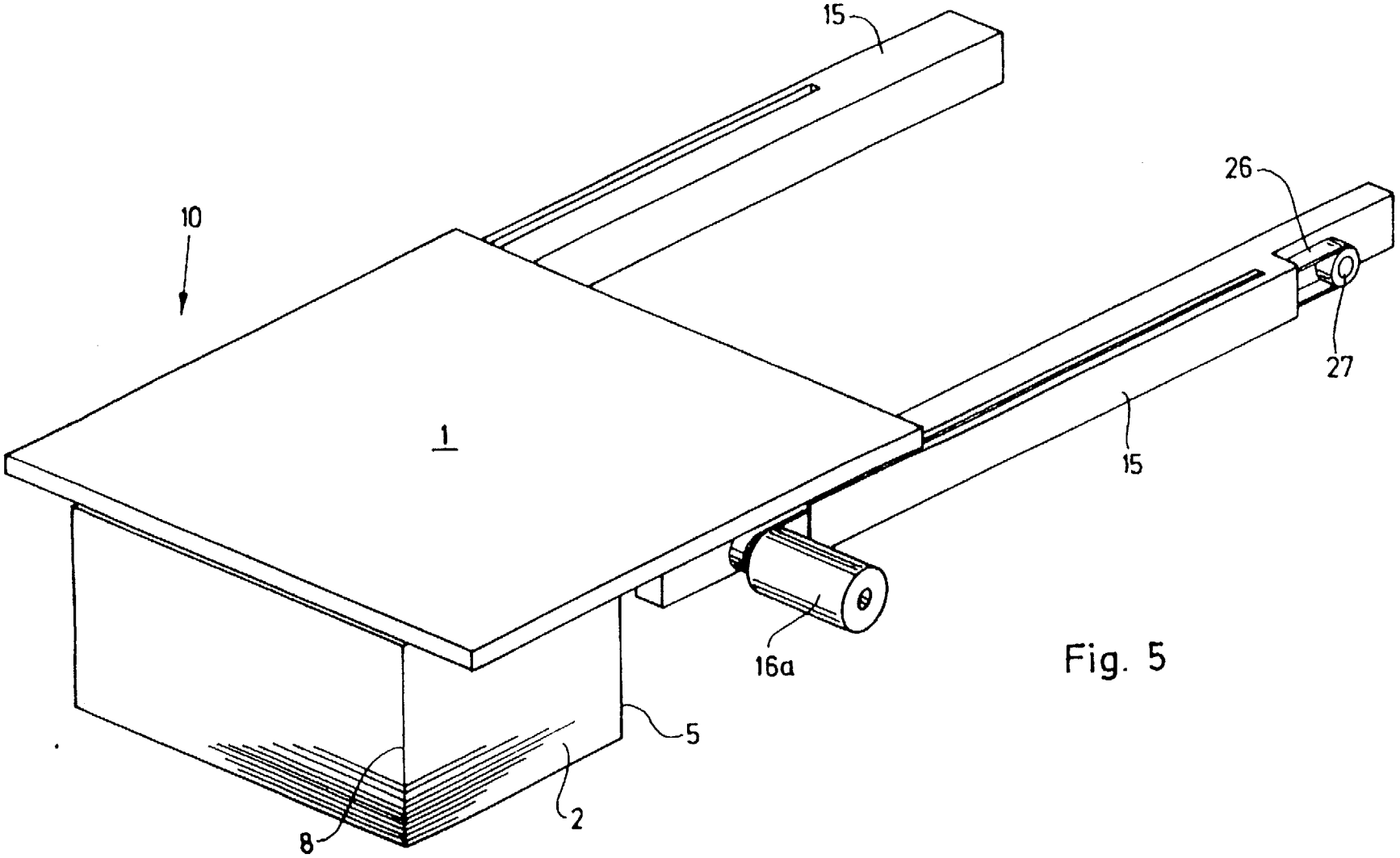
FIG. 5 is another view of FIG. 4 in another operating phase wherein the auxiliary pile carrier is in an extended position.

FIGS. 4 and 5 show the auxiliary pile carrier 1 which is guided on linear units 15. The sheet delivery 10 includes the auxiliary pile carrier 1 displaceably mounted on linear units 15. The auxiliary pile carrier 1 is displaced in a horizontal direction by a separate drive **16*a* which acts upon a belt 26 guided about a return roller 27; in an analogous manner, the opposite linear unit 15 is driven by the drive shaft 16. The linear units 15 can be provided at a leading and a trailing region thereof, respectively, with a preceding and succeeding traverse distance or length, respectively, so as to minimize the loadings for the the drive 16*a*. By means of a terminal switch 21, the auxiliary pile carrier 1 can automatically switch off the motor drive 16*a* when the auxiliary pile carrier 1 has reached the end position thereof (note FIG. 5**).

In the operating phase represented in FIG. 5, the auxiliary pile carrier 1, in the extended condition thereof, overlaps the side 5 of the main sheet pile 2 facing towards the press as well as the side 8 thereof facing away from the press.

Figure 6:
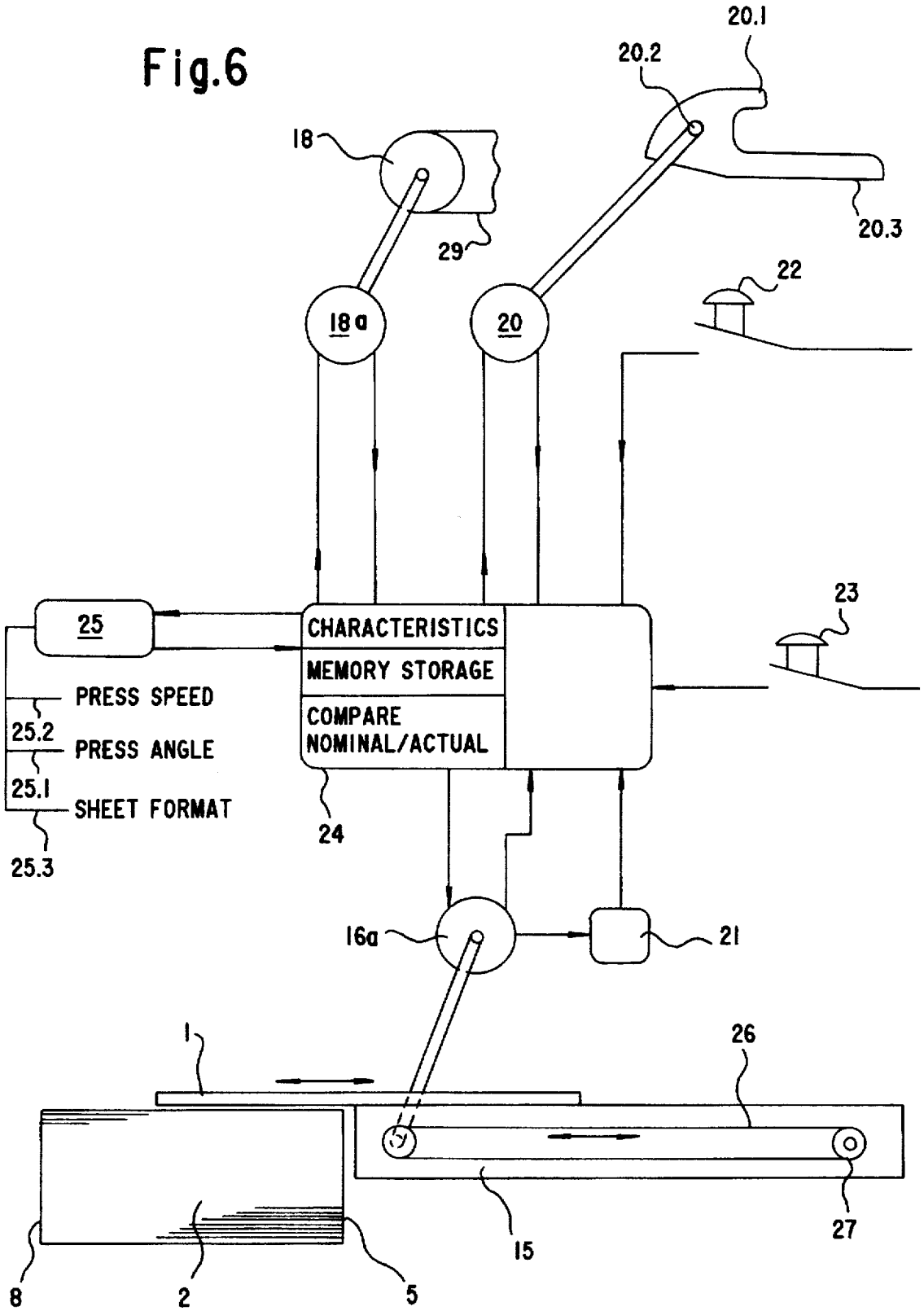
FIG. 6 is a diagrammatic and schematic view of a control device controlling drives of gripper opening cam adjustment equipment, a sheet brake and an auxiliary pile carrier in accordance with actual data of the press.

FIG. 6 shows a control device 24 by which the drives **18*a* and 20, respectively, for the brake surface 29 and the swivelling of the gripper opening cam 20.1, as well as a drive 16*a* for the auxiliary pile carrier 1**, are coordinated in accordance with the determination of actual data for the printing press.

The detector or evaluator of the actual values or data in the press which is represented at 25 receives, for example, the then value of the printing-press rotational angle 25.2 from a transmitter. Before the start of the printing job, the sheet format 25.3 is input into the feeder and delivery and is therefore already available as a parameter. The press speed 25.1 is continuously measured and is likewise available to the control device 24 as a parameter. Nominal or ideal prescribed values for the adjustment of the gripper opening cam 20.1, the brake surface velocity and the insertion velocity of the auxiliary pile carrier 1 over the main sheet pile 2 for specific printing speeds and sheet formats are filed in a nominal or ideal value memory or storage of the control device 24. In order to enable a simultaneous inwardly driven movement of the auxiliary pile carrier 1 and the sheet leading edge 3, the angular position 25.2 of the printing press must also be known. Therefore, information regarding the actual angular position of the printing press is necessary.

The respective actual data of the drives **16*a*, 18*a* and 20, respectively, must be transmitted therefrom to the control device 24. With respect to the drive 16*a* for the auxiliary pile carrier 1, those data are the actual positions of the auxiliary pile carrier 1 and, with respect to the drives 18*a* and 20, the data are the actual brake surface velocity and the actual position of the gripper opening cam 20.1, respectively. The actual position and velocity values, respectively, for the drives 16*a*, 18*a* and 20 are transmitted to the control device 24**, and are therefore available thereat for a reconciliation or adjustment of the nominal/actual data.

Depending upon the press speed and the sheet format, such as the length, for example, of the sheet 3 to be deposited, the braking velocity of the brake surface 29 must be pre-adjusted to an optimum delay value, i.e., a prescribed nominal value must result, which leads to achieving the desired deposition velocity of the sheet 3 which is to be deposited. In order to enable a simultaneous displacement of the leading edge of the auxiliary pile carrier 1 and of the sheet 3 to be deposited, which remains held in the grippers 9, the drive 16a, in order to extend the auxiliary pile carrier 1, must be controlled so that the velocity at which the auxiliary pile carrier 1 is extended coincides with the velocity of displacement of the sheet 3 to be deposited, so that a deposition can occur which is free of relative velocity. The extension of the auxiliary pile carrier 1 must take place upon the arrival of the leading edge of the sheet 3 to be deposited. In addition, the start of the extension of the auxiliary pile carrier 1 must be reconciled with or adjusted to the phase position of the printing press, for which, therefore, the actual value of the press angle 25.2 is determined.

It is also necessary to match the position of the gripper opening cam 20.1 with respect to a swivel point 20.2 to every sheet format 25.1. Also, the fact that a large sheet has a different deposit or dropping behavior onto the main sheet pile 2 than that of a small sheet is taken into account by the position of the gripper opening cam 20.1. The weight of the printing material of the sheet 3 to be deposited also affects the dropping behavior of the sheet 3 to be deposited upon the surface of the main sheet pile 2. Thus, for every type of printing material, respectively, depending upon the format or size 25.1 of the sheet, an optimum instant of gripper opening is determined which, depending upon the sheet format 25.1 and weight of the sheet 3 to be deposited, must be preset in order to attain an optimum delivery and delay behavior.

Assurance must further be provided that the brake surface 29 takes over the sheet 3 to be deposited without any relative velocity, so that the underside of the sheet 3 is not smeared. The respectively prescribed velocity of the brake surface 29 is dependent upon the velocity at which the sheet 3 to be deposited is conveyed, and the start of the braking operation depends upon the opening of the gripper 9 and, therewith, upon the position of the gripper opening cam 20.1, as well as of the press angle 25.2.

The drive 16a is switchable off by a terminal switch 21 after the auxiliary pile carrier 1 has reached the extended position thereof above the main pile 2. By means of a non-stop key 22, the printing press can be stopped at the sheet delivery 10 whereas, by means of a non-stop key 23, the pile separating operation at the auxiliary and the main sheet piles is initiated. The non-stop key 23 issues the starting signal for the performance of the aforedescribed steps of the method according to the invention.

The displacement profile (note FIG. 1), which the drive 18a of the brake surface 29 follows in accordance with or dependent upon parameters of the press and the printing material, corresponds to the velocity of the gripper 9 up to the instant of time represented by the phantom line 7. Thereafter, a delay or retardation period is traversed until the desired deposition velocity is reached. Instead of an abruptly dropping delay flank or leg, a gradually falling delay flank declination can also be prescribed.

We claim:

1. Method of introducing an auxiliary sheet pile carrier above a main sheet pile to be removed, the introduction being effected during uninterrupted feeding of additional sheets above the main sheet pile in a sheet travel direction and in synchronism with the travel of a sheet to be deposited, which comprises:

controlling respective drives at a sheet delivery by a control device which determines actual data of a printing press, so that the auxiliary pile carrier traverses a velocity profile identical with a velocity profile of the sheet to be deposited in order to avoid relative movement between the auxiliary pile carrier and the sheet to be deposited; and determining the velocity profile from a conveying velocity of a gripper for gripping the sheet to be deposited and from a velocity of a brake surface for braking the sheet.

2. Method according to claim 1, which includes controlling the auxiliary pile carrier so that a leading end thereof reaches a position above an end of the main pile facing towards the printing press jointly with a leading end of the respective sheet to be deposited.

3. Method according to claim 1, which includes guiding the auxiliary pile carrier so as to switch off the drive for the auxiliary pile carrier with a switch after the auxiliary pile carrier has reached an end position thereof.

4. Method according to claim 1, which includes guiding the auxiliary pile carrier on linear units furnished with preceding and succeeding traverse distances.

5. Method of introducing an auxiliary sheet pile carrier above a main sheet pile to be removed, the introduction being effected during uninterrupted feeding of additional sheets above the main sheet pile in a sheet travel direction and in synchronism with the travel of a sheet to be deposited, which comprises:

controlling respective drives at a sheet delivery by a control device which determines actual data of a printing press, so that the auxiliary pile carrier traverses a velocity profile identical with a velocity profile of the sheet to be deposited in order to avoid relative movement between the auxiliary pile carrier and the sheet to be deposited; and jointly delaying the sheet to be deposited and the auxiliary pile carrier closely before an end of the main pile facing away from the printing press.

6. Method of introducing an auxiliary sheet pile carrier above a main sheet pile to be removed, the introduction being effected during uninterrupted feeding of additional sheets above the main sheet pile in a sheet travel direction and in synchronism with the travel of a sheet to be deposited, which comprises:

controlling respective drives at a sheet delivery by a control device which determines actual data of a printing press, so that the auxiliary pile carrier traverses a velocity profile identical with a velocity profile of the sheet to be deposited in order to avoid relative movement between the auxiliary pile carrier and the sheet to be deposited; and determining with the control device actual data of the printing press including press speed, press angle and sheet format.

7. Method of introducing an auxiliary sheet pile carrier above a main sheet pile to be removed, the introduction being effected during uninterrupted feeding of additional sheets above the main sheet pile in a sheet travel direction and in synchronism with the travel of a sheet to be deposited, which comprises:

controlling respective drives at a sheet delivery by a control device which determines actual data of a printing press, so that the auxiliary pile carrier traverses a velocity profile identical with a velocity profile of the sheet to be deposited in order to avoid relative movement between the auxiliary pile carrier and the sheet to be deposited; and reconciling a position of a gripper opening cam, via a drive assigned thereto, with a drive of a sheet brake, and an acceleration profile thereof by comparison with an acceleration profile stored in a memory of the control device.

8. Method of introducing an auxiliary sheet pile carrier above a main sheet pile to be removed, the introduction being effected during uninterrupted feeding of additional sheets above the main sheet pile in a sheet travel direction and in synchronism with the travel of a sheet to be deposited, which comprises:

controlling respective drives at a sheet delivery by a control device which determines actual data of a printing press, so that the auxiliary pile carrier traverses a velocity profile identical with a velocity profile of the sheet to be deposited in order to avoid relative movement between the auxiliary pile carrier and the sheet to be deposited; and controlling the drives, respectively, of the auxiliary pile carrier, a sheet brake and gripper opening cam adjusting equipment by the control device dependent upon actual data of the printing press.

9. Method of introducing an auxiliary sheet pile carrier above a main sheet pile to be removed, the introduction being effected during uninterrupted feeding of additional sheets above the main sheet pile in a sheet travel direction and in synchronism with the travel of a sheet to be deposited, which comprises:

controlling respective drives at a sheet delivery by a control device which determines actual data of a printing press, so that the auxiliary pile carrier traverses a velocity profile identical with a velocity profile of the sheet to be deposited in order to avoid relative movement between the auxiliary pile carrier and the sheet to be deposited; and providing a brake surface of a sheet brake, during the introduction of the auxiliary pile carrier, with a velocity profile corresponding to a speed of a gripper for gripping the sheet to be deposited, up to an instant of time at which the gripper is opened.

10. Method according to claim 9, which includes decelerating the brake surface of the sheet brake, after the instant of time at which the gripper is opened, until the brake surface reaches a sheet deposit velocity of the sheet to be deposited.

11. An apparatus for a continuous delivery of sheets to a main sheet stack, comprising:

a gripper chain system having grippers for feeding sheets to a main sheet stack;

an auxiliary stacking receptacle being inserted in the sheet travel direction above the main sheet stack when the main sheet stack needs to be removed;

a drive system for transporting said auxiliary stacking receptacle;

a braking system having a braking face for braking the sheets; and a control device for controlling said drive system, said drive system being controlled in accordance with current operating parameters of a multiphase speed profile, for controlling the speed of the auxiliary stacking receptacle in a first phase of an insertion motion as a function of a feeding speed of said gripper chain system and in a second phase of said insertion motion in adaptation to the motion of the sheet being delayed by said braking system.

12. The apparatus according to claim 11, wherein said speed of said auxiliary stacking receptacle in said first phase of said insertion motion is controlled in such a way that it corresponds to said feeding speed of said gripper chain system.

13. The apparatus according to claim 11, wherein said braking system has a brake drive controlled by said control device as a function of current operating parameters.

14. The apparatus according to claim 11, wherein during said second phase of said insertion motion, said speed of said auxiliary stacking receptacle is controlled in adaptation to said speed of said braking face of said braking system.

* * * * *